United States Patent [19]

Van Raaij

[11] Patent Number: 4,580,312

[45] Date of Patent: Apr. 8, 1986

[54] BROOM AND SUCTION ASSEMBLY FOR A STREET SWEEPER

[76] Inventor: Karel W. M. Van Raaij, 1800 AG, Alkmaar Holland, Netherlands

[21] Appl. No.: 579,163

[22] Filed: Feb. 10, 1984

[51] Int. Cl.[4] ..... E01H 1/08

[52] U.S. Cl. ..... 15/339; 15/340; 15/354

[58] Field of Search ..... 15/340, 87, 354, 339

[56] References Cited

U.S. PATENT DOCUMENTS

| | | | |
|---|---|---|---|
| 2,996,742 | 8/1961 | Aimers et al. | 15/87 |
| 3,300,807 | 1/1967 | Berkowitz | 15/340 |
| 3,436,788 | 4/1969 | Tamny | 15/340 |
| 3,490,090 | 1/1970 | Harrison | 15/340 X |
| 3,506,998 | 4/1970 | Perry | 15/340 X |
| 3,613,915 | 10/1971 | Vita | 15/340 X |
| 3,675,267 | 7/1972 | Klawitter | 15/340 |
| 3,722,025 | 3/1973 | Gledhill | 15/340 |

FOREIGN PATENT DOCUMENTS

| | | | |
|---|---|---|---|
| 632390 | 1/1962 | Italy | 15/340 |

*Primary Examiner*—Chris K. Moore

*Attorney, Agent, or Firm*—Rogers, Howell, Moore & Haferkamp

[57] ABSTRACT

A vacuum street sweeper vehicle (2) having a hopper (14) for receiving debris and a vacuum system (16) for suctioning debris and depositing same in the hopper, is provided with an intake broom and suction carriage assembly (18) on the vehicle forward of the front wheels (8) and laterally movable relative to the direction of travel of the vehicle. A rigid suction transfer passage tube (26) extends upwardly from the intake broom and suction assembly through a front operator cab (12) to the hopper.

28 Claims, 7 Drawing Figures

FIG. 1.
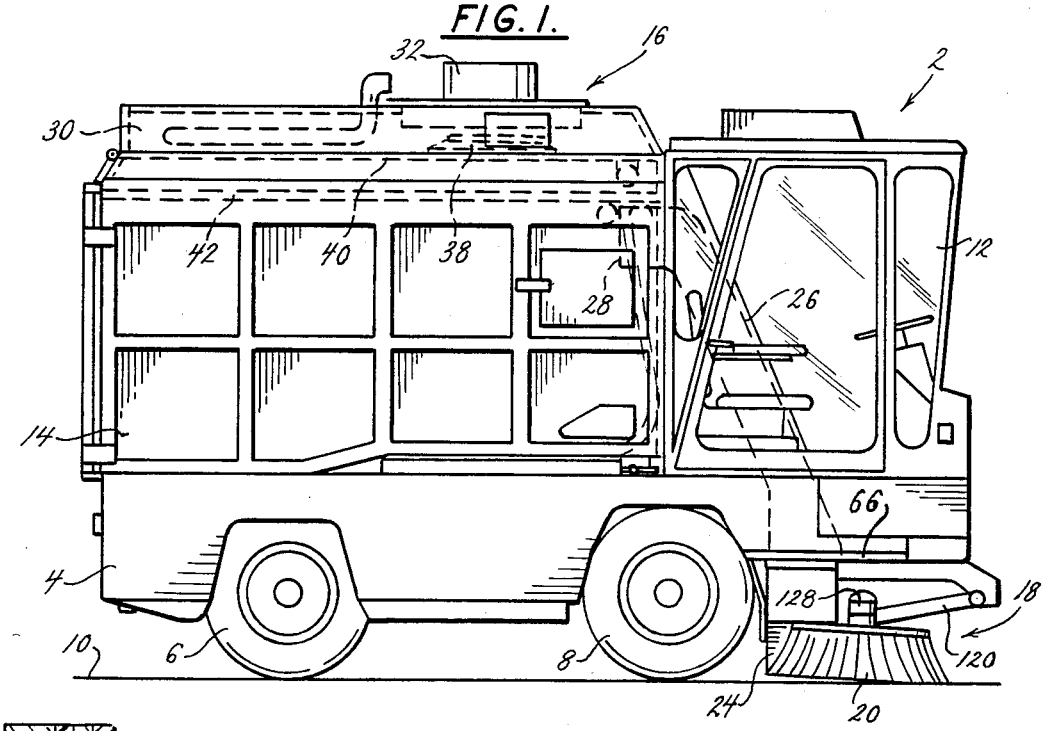
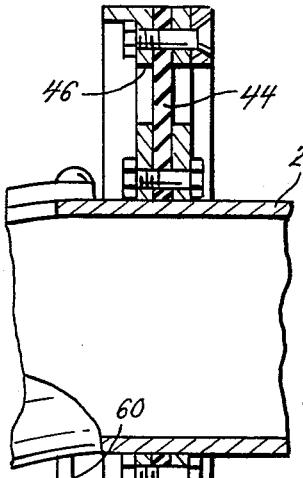
FIG. 7.
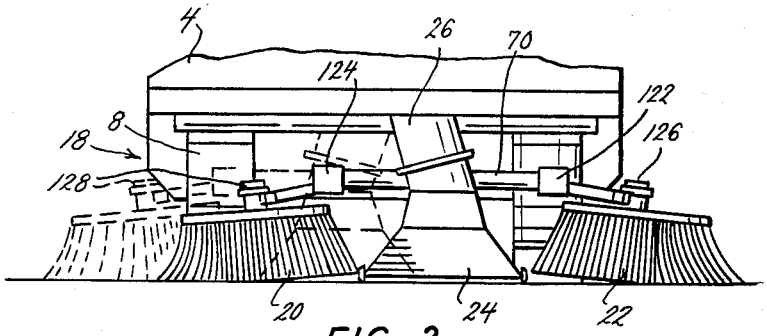
FIG. 2.
FIG. 3.
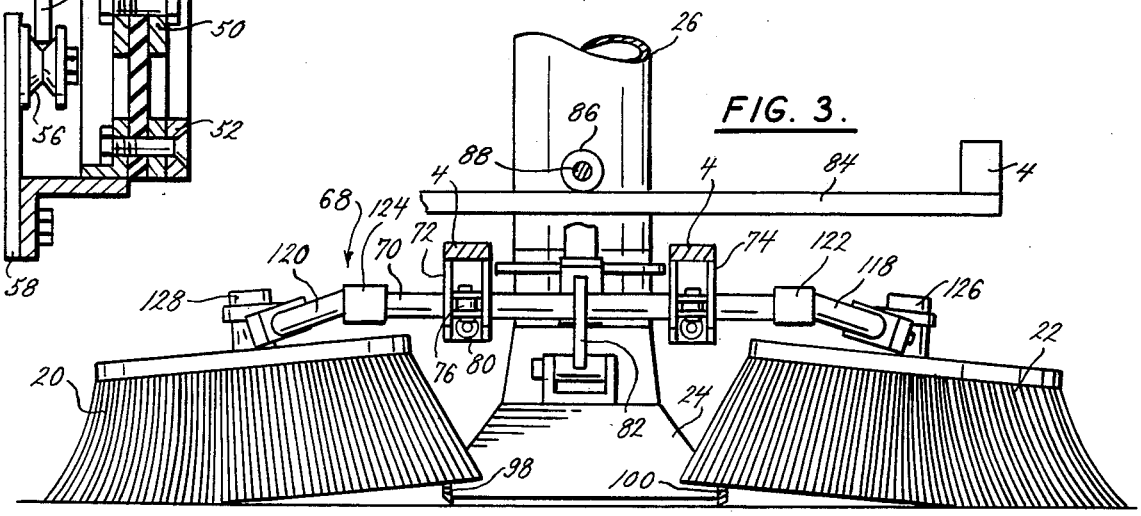

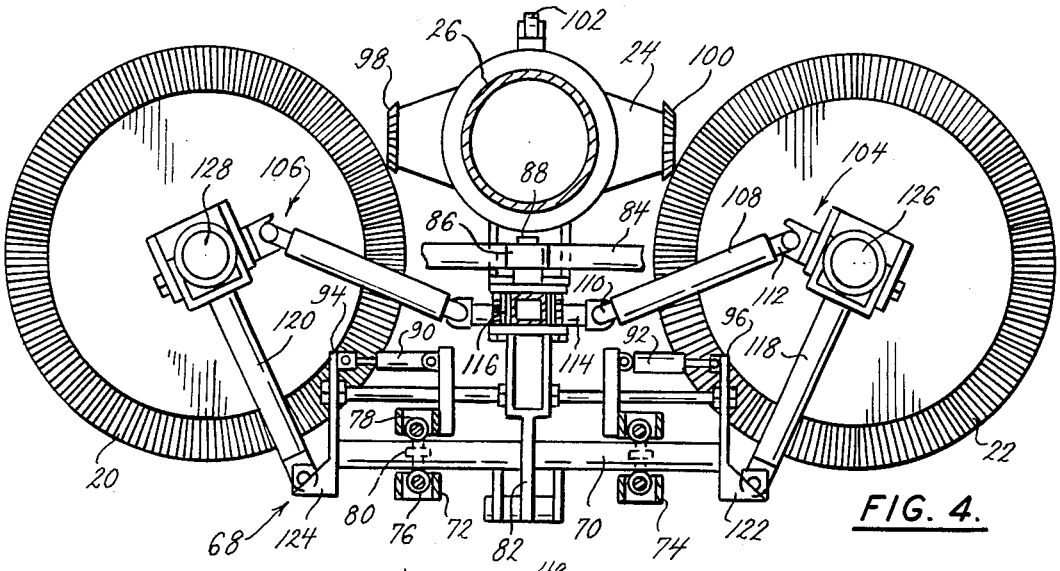
FIG. 4.
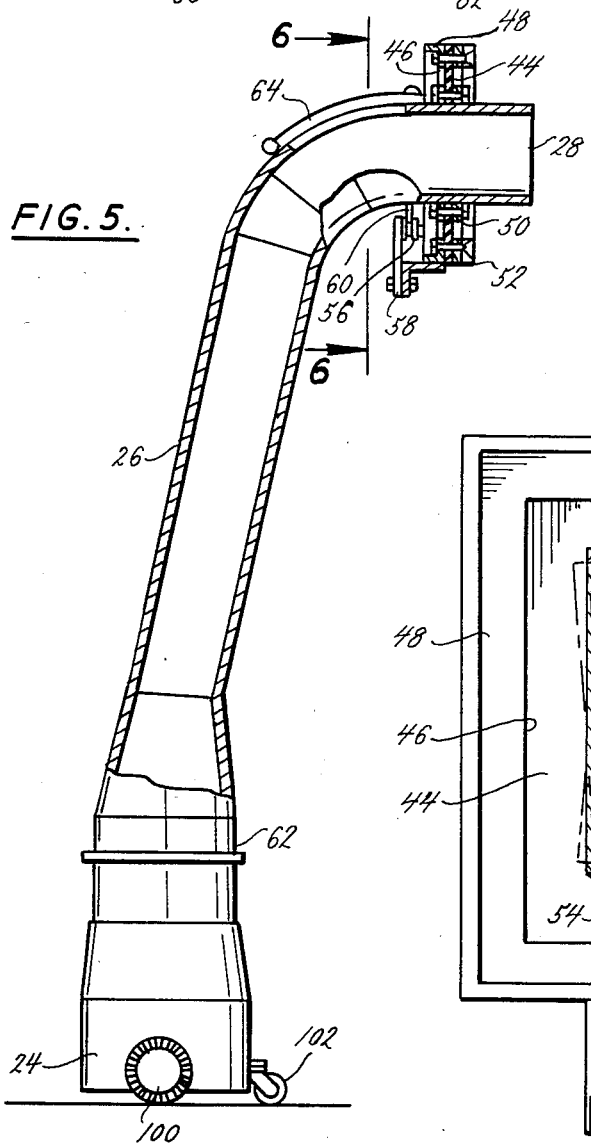
FIG. 5.
FIG. 6.
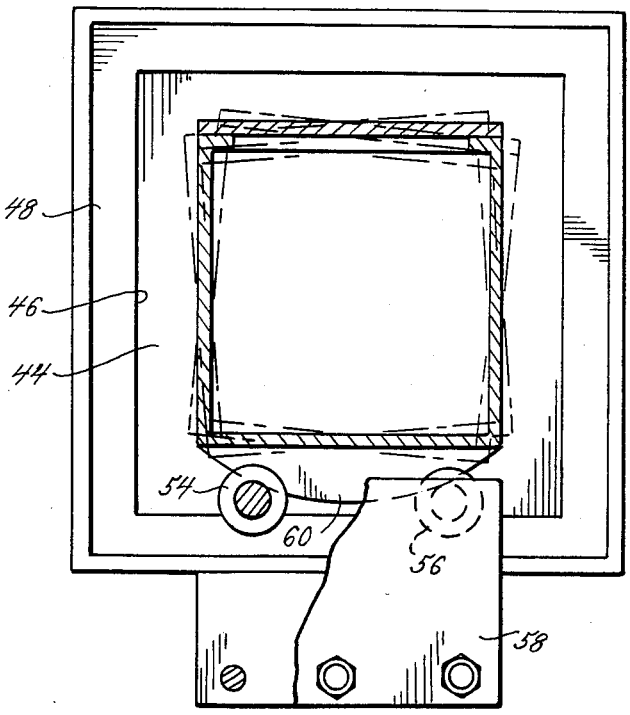

BROOM AND SUCTION ASSEMBLY FOR A STREET SWEEPER

BACKGROUND AND SUMMARY

The invention relates to vacuum street sweepers, including the motorized vehicular type having a hopper for receiving debris and a vacuum system for suctioning debris and depositing same in the hopper.

Known street sweeper vehicles typically have a broom and intake suction nozzle secured to the chassis of the vehicle in fixed relation, providing a fixed path of suctioned sweeping relative to the direction of vehicle movement. This construction prevents sweeping into odd corners, and prevents the sweeping of square areas. Additionally, the width of the swept path is fixed.

The present invention provides a vacuum street sweeper vehicle enabling the cleaning of odd corners and square areas. The swept and suctioned path may be changed relative to the direction of vehicle movement. The width of the path may also be changed, for example to minimize vehicle clearance requirements in restricted areas by making the broom path no wider than the vehicle itself. An intake broom and suction assembly on the vehicle is laterally moveable relative to the direction of travel of the vehicle.

Known suction transfer passages between the suction nozzle and the hopper to employ flexible rubber hoses, elongated corrugated bellows, or the like. This arrangement suffers shortended life from rapid abrasion of the relatively soft material from suctioned debris impacting therealong during its passage to the hopper.

In the present invention, a substantially rigid suction transfer tube, preferably a solid metal pipe, is provided between the broom and suction assembly and the hopper inlet port. A special sealing gasket is provided around the upper end of the suction tube at the hopper inlet port and permits slight rotational tilting of the tube upper end which in turn permits lateral movement of the lower end of the tube and the suction nozzle, while maintaining sealed vacuum suction power. The tube is articulated at its lower end in sleeve relation with the nozzle, and a second sealing gasket permits movement thereat. The construction affords extended life of the suction transfer passage, and permits lateral movement of the intake broom and suction assembly.

Known vacuum street sweepers are prone to having the incoming transfer passage clogged by bulky debris. The unclogging process typically requires the operator to stop the vehicle, leave the cab, disassemble the hose from the suction nozzle, remove the offending article of debris, and reassemble the passage.

In the present invention, the operator may unclog the transfer passage without leaving the cab nor disassembling and then reassembling various components. The suction transfer passage extends through the operator cab and has an openable door giving the operator access to the inside of the transfer passage for withdrawing a clogging object. This affords a faster, more efficient solution to the clogging problem endemic to vacuum street sweepers.

Known vacuum street sweepers typically have a broom and suction nozzle configuration wherein both the broom and nozzle are curbside midship, or the broom is curbside midship and the nozzle is in the middle of the vehicle midship, or brooms are in front and the nozzle is midship. Midship placement of the nozzle and/or brooms prevents the operator in a front mounted cab from visually monitoring suction and/or sweeping performance. A midship nozzle, and front brooms, may leave dirt streaks between the brooms and the nozzle when the vehicle turns a corner.

The design in the present invention enables the broom and suction assembly to be forward of the front wheels. Front pick-up permits sweeping very close to obstacles. Front pick-up when combined with front steering permits the operator previously unattainable access to odd corners. The operator cab is at the front of the vehicle and has a window in the floor giving the operator improved visibility of the intake broom and suction assembly for monitoring performance.

Known street sweepers typically employ circular gutter brooms with steel bristles. In order to provide rigid fixation in the appropriate planes, relatively heavy broom mechanisms are employed, with substantial weight on the broom. This increases the wear on the abrasive steel broom fiber, shortening life.

In the present invention, a jointed lever broom fixation design is afforded which minimizes wear on the broom fiber by means of a light weight broom mechanism, yet rigidly fixes the broom in the appropriate planes. A relatively light support structure is employed with broom-supporting arms attached to a laterally moveable broom and suction nozzle carriage at fulcrums spaced from the brooms, to minimize weight on the latter. A shaft has adjustably moveable collars along the axis thereof for fixing the brooms in the proper planes, and universal joints permitting rotation of the shaft and controlling forward pitch of the brooms.

The invention further provides a tight pocket between a pair of rotating brooms on opposite sides of a central suction nozzle therebetween for improved pick-up. Guide wheels on opposite sides of the suction nozzle ride adjacent the brooms and facilitate the tight pocket.

BRIEF DESCRIPTION OF THE DRAWINGS

FIG. 1 is a side elevation view of a vacuum street sweeper vehicle incorporating a broom and suction assembly in accordance with the invention.

FIG. 2 is a front view of the lower portion of the structure of FIG. 1, showing laterally shifted positions of the broom and suction assembly.

FIG. 3 is an enlarged partially sectional front view of the suction and broom assembly.

FIG. 4 is an enlarged partially sectional top view of the broom and suction assembly.

FIG. 5 is an enlarged partially sectional side view of the suction transfer tube of FIG. 1.

FIG. 6 is an enlarged sectional view taken along line 6—6 of FIG. 5.

FIG. 7 is an enlarged sectional view of the upper portion of the structure of FIG. 5.

DETAILED DESCRIPTION

There is shown in FIG. 1 a vacuum street sweeper motorized vehicle 2 having a chassis or frame 4 supported on rear wheels 6 and front steering wheels 8 on street surface 10. An operator cab 12 is on the chassis at the front of the vehicle forward of a debris-receiving hopper 14 on the chassis. Vacuum system 16 suctions debris and deposits same in the hopper. Debris is collected through an intake broom and suction assembly 18 having a pair of rotating brooms 20 and 22 on opposite sides of a central suction nozzle 24 therebetween. Debris is transferred upwardly in transfer passage 26 through cab 12 to an inlet port 28 in the front side wall of the hopper, FIGS. 1 and 5. An exhaust blower compartment 30 is above the hopper and includes a vacuum blower 32 drawing air through port 38 and then directing it rearwardly through compartment 30 for exit through exhaust port 36, which creates upward vacuum suction force through port 38 in the top wall 40 of the hopper beneath the blower, which in turn provides the rearward suction force through hopper inlet port 28. A coarse screen or perforated plate 42 extends laterally across the hopper above port 28 and below port 38 to prevent debris from reaching port 38, such that the debris settles in the bottom of hopper 14. Screen 42 permits dust and the like to pass therethrough, to maintain vacuum suctioning power.

Intake broom and suction assembly 18 on vehicle 2 is laterally moveable relative to the direction of travel of the vehicle, FIG. 2. Passage 26 is a substantially rigid suction transfer tube, preferably of acid-resistant stainless steel or an abrasion resistant alloy. Sealing means 44, FIGS. 5–7, is provided around the upper end of the tube at hopper inlet port 28 and permits the noted lateral movement of the lower end of the suction tube at the broom and suction assembly. Seal 44 is a resilient from a member gasket of rubber or the like around the outer perimeter of the upper end of tube 26 closing the gap to the inner perimeter of the hopper inlet port formed by square opening 46 in front hopper side wall 48. Gasket 44 lies in a substantially vertical and lateral plane and permits slight rotational tilting of the tube upper end about a longitidunal forward-rearward axis as the lower end of the tube moves laterally with the broom and suction assembly. Gasket 44 is rigidly secured and sealed along its inner and outer peripheral boundaries respectively to the upper end of tube 26 and the hopper inlet port at opening 46 by bolted templates 50 and 52 or the like. Gasket 44 flexes in its resilient material between its peripheral boundaries laterally left-right and vertically up-down, FIG. 6. A set of rollers 54 and 56 are mounted to the front hopper side wall or frame by plate 58 for supporting and guiding the upper tube end in its noted motion by means of lower arcuate runner 60 depending therefrom. The suction tube is articulated at its lower end in sleeve relation with the suction nozzle, and a second seal provided by a grooved ring gasket 62 between the tube lower end and the nozzle and permits lateral movement and upward movement of the nozzle along the tube lower end.

Intake broom and suction assembly 18 is forward of front wheels 8. Suction transfer passage tube 26 extends through front operator cab 12 and has an openable door 64, FIG. 5, at the bend of the tube at its narrowest point allowing access by the operator to the inside of passage 26 for unclogging the latter when necessary. Window 66 is provided in the floor of the cab enabling the operator to visually monitor the swept and suctioned street surface immediately proximate the broom and suction assembly.

Intake broom and suction nozzle assembly 18 is part of a laterally displaceable carriage 68 on the chassis, FIGS. 3 and 4. The carriage includes a lateral cross bar 70 supporting the pair of rotary brooms at its ends and moveably mounted to the chassis by roller bearing members 72 and 74 rigidily secured to chassis 4. Member 72 is a channel-like member depending downwardly from chassis 4, having front and rear roller bearings 76 and 78, and a bottom roller bearing 80 upon which cross bar 70 rides in its left-right lateral movement relative to the direction of forward-reverse movement of the vehicle. Bearing member 74 is comparable. A tie bar 82 extends rearwardly and connects suction nozzle tube to cross bar 70 such that the suction nozzle tube and the cross bar move laterally in unison. A second lateral cross bar 84 is rigidly mounted and fixed to chassis 4. The suction nozzle tube includes a roller 86 mounted thereto and supporting the suction nozzle tube on cross bar 84. Roller 86 is rotatable about a forward-rearward longitudinal axis on a trunion 88 secured to the suction nozzle tube such that the roller rolls laterally left-right along cross bar 84 as the carriage moves laterally. The carriage may be moved by mechanical linkage, electrical, or hydraulic means such as 90 and 92 between chassis 4 and carriage portions 94 and 96. Guide wheels 98 and 100 are provided on opposite sides of the suction nozzle riding adjacent respective brooms, facilitating a tight pocket between the brooms and the central suction nozzle. A support wheel 102 is provided at the rear of the suction nozzle.

Jointed lever broom fixation mechanisms 104 and 106 rigidly fix respective brooms in a left-right lateral plane and in a forward-rearward longitudinal plane relative to carriage 68. A splined shaft 108 has mounting collars 110 and 112 adjustably moveable along the axis thereof for fixing the broom in the noted planes. The collars are part of universal joints at the ends of the shaft connected respectively to a broom and central tie bar 82 of the carriage and permitting rotation of the shaft to control forward pitch of the broom. Mechanism 106 is comparable. Rotation of central splined shaft 108 may be provided by a shift linkage controlled pivotable concentric sleeve gear 116, vertical rack gear, or the like on the carriage. Support arms 118 and 120 are hinged between the carriage at 122 and 124 and respective brooms and allow free floating of the brooms in the up-down vertical plane from fulcrums 122 and 124 spaced from the brooms, to minimize weight on the latter and reduce wear on the fibers of the brooms. The brooms are rotated by hydraulic motors 126 and 128.

It is recognized that various modifications are possible within the scope of the appended claims.

I claim:

1. In a vacuum street sweeper vehicle having a hopper for receiving debris and a vacuum system for suctioning debris and depositing same in said hopper, an intake broom and suction assembly on said vehicle laterally moveable relative to the direction of travel of said vehicle, a substantially rigid suction transfer tube between said broom and suction assembly and an inlet port in said hopper for transmitting suctioned debris to said hopper, and sealing means around an upper end of said suction tube at said hopper inlet port permitting said lateral movement of the lower end of said suction tube at said broom and suction assembly.

2. The invention according to claim 1 wherein the assembly includes a suction nozzle joined to the lower end of the suction tube and wherein said suction tube is articulated at its said lower end, and comprising second sealing means at said lower end of said suction tube permitting said lateral movement and permitting upward movement of the suction nozzle on said assembly.

3. In a vacuum street sweeper vehicle having a hopper for receiving debris and a vacuum system for suctioning debris and depositing same in said hopper, an intake broom and suction assembly on said vehicle laterally moveable relative to the direction of travel of said vehicle, said vehicle including an operator cab, a suction transfer passage between said broom and suction assembly and an inlet port in said hopper for transmitting suctioned debris to said hopper, said passage extending through said cab and having an openable door allowing access by the operator to the inside of said passage for unclogging the latter when necessary.

4. In a vacuum street sweeper vehicle having a hopper for receiving debris and a vacuum system for suctioning debris and depositing same in said hopper, an intake broom and suction assembly on said vehicle laterally moveable relative to the direction of travel of said vehicle, said vehicle being on a chassis having front and rear wheels supporting the vehicle on the street surface, said broom and suction assembly being forward of said front wheels, said vehicle including an operator cab at the front thereon with a window in the floor of the cab enabling the operator to visually monitor the swept and suctioned street surface immediately proximate said broom and suction assembly.

5. In a vacuum street sweeper vehicle having a hopper for receiving debris and a vacuum system for suctioning debris and depositing same in said hopper, an intake broom and suction assembly on said vehicle laterally moveable relative to the direction of travel of said vehicle, a pair of rotating brooms spaced laterally from one another to define a space between them, a suction nozzle on the assembly positioned rearward of the axis of rotation of the brooms, and guide wheels rotatably supported on opposite sides of said suction nozzle and adjacent the respective brooms defining a tight pocket for collecting debris between said brooms and said suction nozzle.

6. A vacuum street sweeper vehicle comprising:

a chassis supported on wheels;

an operator cab on said chassis;

a hopper on said chassis for receiving debris;

a vacuum system for suctioning debris and depositing same in said hopper;

a laterally displaceable intake broom and suction tube nozzle carriage on said chassis, comprising:

a lateral cross bar supporting a pair of rotary brooms at its ends and moveably mounted to said chassis for left-right lateral movement relative to the direction of forward-reverse movement of said vehicle; and a tie bar connecting said suction tube nozzle to said cross bar such that said suction tube nozzle and said cross bar move laterally in unison.

7. The vacuum street sweeper vehicle according to claim 6 comprising a second lateral cross bar rigidly mounted to said chassis, and wherein said suction tube nozzle includes a roller mounted thereto and supporting said suction tube nozzle on said second cross bar, said roller being rotatable about a forward-reverse longitudinal axis on a trunion secured to said suction tube nozzle, said roller rolling laterally left-right along said second cross bar as said carriage moves laterally.

8. The vacuum street sweeper vehicle according to claim 6 comprising a substantially rigid suction transfer tube extending from said suction tube nozzle upwardly into said hopper through an inlet port in a front side wall of the latter, and comprising a sealing gasket around the outer perimeter of the upper end of said tube closing the gap to the inner perimeter of said hopper inlet port, said gasket lying in a substantially vertical and lateral plane and permitting slight rotational tilting of said tube upper end about a longitudinal forward-rearward axis as the lower end of said tube moves laterally with said carriage.

9. The vacuum street sweeper vehicle according to claim 8 wherein said gasket comprises a resilient frame member rigidly secured and sealed along its inner and outer peripheral boundaries respectively to said upper end of said tube and said hopper inlet port, and flexing its material between said peripheral boundaries laterally left-right and vertically up-down.

10. The vacuum street sweeper vehicle according to claim 9 comprising roller means mounted on said chassis and supporting an arcuate runner depending from said tube upper end for guiding said rotational tilting.

11. The vacuum street sweeper vehicle according to claim 8 wherein said tube is articulated at its said lower end in sleeve relation with said nozzle, and grooved ring seal gasket means between said tube lower end and said nozzle for permitting upward movement of said nozzle relative to said tube lower end while maintaining an air seal therebetween.

12. In a vacuum street sweeper vehicle supported on front and rear wheels and having an operator cab extending forward of the front wheels, a hopper rearward of the operator cab for receiving debris, a tube for transmitting debris to the hopper, a vacuum system for suctioning debris through the tube and depositing same in said hopper, an intake broom and suction assembly including a suction nozzle connected to the tube and means to support the intake broom and suction assembly forward of said front wheels and extending beneath the operator cab.

13. In a vacuum street sweeper vehicle supported on front and rear wheels and having a hopper for receiving debris and a vacuum system for suctioning debris and depositing same in said hopper, an intake broom and suction assembly forward of said front wheels, said vehicle including an operator cab, an inlet port in the hopper, and a suction transfer passage between said broom and suction assembly and the inlet port for transmitting suctioned debris to said hopper, said passage extending through said cab and having an openable door allowing access by the operator to the inside of said passage for unclogging the latter when necessary.

14. A vacuum street sweeper vehicle comprising: a chassis supported on wheels; an operator cab on said chassis; a hopper on said chassis for receiving debris; a vacuum system for suctioning debris and depositing same in said hopper; a laterally displaceable intake suction nozzle assembly on said chassis laterally moveable relative to the direction of travel of said vehicle, a substantially rigid suction transfer tube between said suction assembly and an inlet port in said hopper for transmitting suctioned debris to said hopper, and sealing means around an upper end of said suction tube at said hopper inlet port permitting said lateral movement of the lower end of said suction tube at said intake suction assembly.

15. The vacuum street sweeper vehicle according to claim 14 wherein said suction tube is articulated at its lower end, and comprising second sealing means at said lower end of said suction tube between the suction tube and the intake suction nozzle permitting said lateral movement.

16. A vacuum street sweeper vehicle comprising: a chassis supported on wheels; an operator cab on said chassis; a hopper on said chassis for receiving debris; a vacuum system for suctioning debris and depositing same in said hopper; a laterally displaceable intake broom carriage assembly on said chassis laterally moveable relative to the direction of travel of said vehicle, a pair of rotating brooms, means for supporting the rotating brooms from the carriage assembly while allowing free vertical floating movement of the brooms and adjustment of the forward pitch of the brooms comprising support arms extending laterally between fulcrums on said brooms and on said carriage assembly allowing free vertical floating of said brooms to minimize weight on the latter and reduce wear on the fibers thereof, the lengths of the support arms controlling the lateral positions of the brooms, the support arms having mounting collars adjustably moveable along the axis thereof to vary the effective lengths of the support arms for adjusting the lateral positions of said brooms, the fulcrums including universal joints whereby rotation of said support arms controls forward pitch of said brooms, and means for rotating the support arms.

17. In a street sweeper vehicle having a hopper for receiving debris and a vacuum system for holding a subatmospheric pressure in the hopper and for suctioning debris and depositing same in the hopper, an intake broom and suction assembly, an inlet port to the hopper, a substantially rigid suction transfer tube extending from the broom and suction assembly to the inlet for transmitting suctioned debris to the hopper, sealing means between the hopper inlet and the transfer tube to maintain subatmospheric pressure from the hopper through the transfer tube, an operator cab forming part of the vehicle, the transfer tube having a secton extending through the operator cab, an opening in the section, a door covering the opening, and means mounting the door to the tube section and allowing access to the opening for unclogging the transfer tube.

18. The vacuum street sweeper vehicle of claim 12 wherein the operator cab includes a floor, and a window in the floor to permit visual inspection of the broom and suction assembly from within the operator cab.

19. The vacuum street sweeper of claim 12 wherein the operator cab has a floor, side walls defining a cab interior therewithin and extending upwardly from the floor and outwardly relative to the cab interior, and windows in the side walls enabling an operator to look downwardly at areas immediately adjacent the sides of the vacuum street sweeper below the operator cab thereof.

20. The vacuum street sweeper of claim 19 including a window in the floor to permit visual inspection of the broom and suction assembly from within the operator cab.

21. The vacuum street sweeper of claim 12 wherein the tube has a section between the suction nozzle and the hopper extending through the operator cab.

22. The vacuum street sweeper of claim 21 wherein the hopper has a front wall and the operator cab has a rear wall within no more than a few inches of the hopper front wall.

23. The vacuum street sweeper of claim 21 wherein the tube has a single bend within the operator cab, and an access door at the bend to permit cleanout of clogging debris from within the tube.

24. In a vacuum street sweeper vehicle having a hopper for receiving debris, a tube for transmitting debris to the hopper, a vacuum system for suctioning debris through the tube and into the hopper, an intake broom and suction assembly, the intake broom and suction assembly having a frame supported by the vehicle, a suction nozzle supported by the frame and connected to the tube, at least one rotary broom and broom housing, means to rotate the broom about a generally vertical axis relative to the broom housing, a first arm having first and second ends, a universal joint for connecting the first end of the first arm to the frame, a universal joint for connecting the second end of the first arm to the broom housing whereby rotation of the first arm turns the broom housing to vary the pitch of the axis of rotation of the broom, and a second arm having first and second ends, the first end of the second arm being connected to the broom housing, and means pivotally connecting the second end of the second arm to the frame at a point spaced laterally from the universal joint that connects the first end of the first arm to the frame.

25. The vacuum street sweeper vehicle of claim 24 including a first element comprises a bar extending transversely of the vehicle, a second element comprising rollers, means to connect one of the elements to the vehicle, means to connect the other of the elements to the frame with the rollers in contact with the bar, and means to move the frame in a transverse direction relative to the vehicle with the rollers and bar guiding the direction of movement of the frame to the said transverse direction.

26. The vacuum street sweeper vehicle of claim 25 wherein the moving means comprises a hydraulic piston and a cylinder, one connected to the vehicle and the other connected to the frame.

27. In a vacuum street sweeper vehicle having a hopper for receiving debris, an intake broom and suction assembly including a frame supported by the vehicle, a suction nozzle, a tube connected between the suction nozzle and the hopper, a vacuum system for maintaining a vacuum in the tube to suction debris from the suction nozzle through the tube and deposit the debris into the hopper, a pair of brooms each having downwardly directed bristles oriented in a circle, means to rotatably support the brooms from transversely spaced points on the frame for rotation about generally vertical axes and to position the brooms with a space between the inbound limits of the bristles of the two brooms to define an open path therebetween, and means to support the suction nozzle from the frame generally midway between the brooms and rearward of the axes of rotation of the brooms and therefore in the open path.

28. The vacuum street sweeper of claim 27 including a pair of wheels, means to rotatably mount the wheels on opposite sides of the suction nozzle at positions adjacent the bristles of the respective brooms with the suction nozzle extending therebetween in the open path.

* * * * *